United States Patent [19]

Lepley

[11] 4,079,848

[45] Mar. 21, 1978

[54] BOTTOM SILO UNLOADER

[75] Inventor: James W. Lepley, Smithville, Ohio

[73] Assignee: Flying Dutchman, Inc., Smithville, Ohio

[21] Appl. No.: 720,557

[22] Filed: Sep. 7, 1976

[51] Int. Cl.[2] ..... B65G 65/46

[52] U.S. Cl. ..... 214/17 DA; 222/228

[58] Field of Search ..... 214/17 D, 17 DA; 222/228, 410; 277/142, 105, 102, 106; 259/DIG. 16, 107, 108; 68/23.6, 23.7; 198/558, 672

[56] References Cited

U.S. PATENT DOCUMENTS

| | | | |
|---|---|---|---|
| 2,293,616 | 8/1942 | Meyers | 277/14 V |
| 2,758,685 | 8/1956 | Sisson | 68/236 |
| 3,062,555 | 11/1962 | Britton | 277/105 |
| 3,828,947 | 8/1974 | Leply | 214/17 DA |
| 3,908,411 | 9/1975 | Fahmie | 68/237 |

*Primary Examiner*—Drayton E. Hoffman
*Assistant Examiner*—Lawrence E. Williams
*Attorney, Agent, or Firm*—Mason, Kolehmainen, Rathburn & Wyss

[57] ABSTRACT

A silo unloader for a bottom unloading type silo having a discharge opening in the bottom wall thereof comprises a housing adapted to be mounted in said opening and including an upper wall having a shaft opening. The shaft is supported on bearings in the housing below the upper wall and the shaft extends upwardly through the shaft opening into the silo for supporting a plurality of flexible silage dislodging members which rotate with the shaft. A rotary seal between the shaft and the shaft opening in the upper housing wall comprises an inside annular collar around the shaft extending upwardly of the upper wall of the housing and an outside annular collar around the inside collar and supported by the shaft to project downwardly below the upper end of the inside collar forming an overlapping seal between the relatively rotating collars. The lap seal prevents silage, water or other materials from moving downwardly through the shaft opening in the housing wall around the shaft and thus shields the bearings in the housing resulting in longer bearing life and reduced maintenance.

3 Claims, 3 Drawing Figures

BOTTOM SILO UNLOADER

BACKGROUND OF THE INVENTION

1. Field of the Invention

The present invention relates to silo unloaders for bottom unloading type silos and more particularly to silo unloaders of the character described which employ a vertical shaft extending upwardly of a discharge opening in a silo bottom wall for supporting a plurality of flexible silage dislodging members which rotate with the shaft to dislodge the silage material.

2. Description of the Prior Art

The silo unloaders of the type adapted to be mounted in the bottom discharge opening of a silo bottom wall such as those disclosed in U.S. Pat. Nos. 3,907,131 and 3,942,656 have proven highly effective for dislodging the silage material from the lower end portion of the mass of silage contained in a silo and delivering this dislodged material at suitable feed rates through a bottom discharge opening in the bottom wall of the silo. These type of silo unloaders employ a vertical shaft which projects upwardly from support bearings which are contained in an enclosure or housing mounted in the discharge opening in the bottom wall of the silo. The shaft supports a plurality of flexible silage dislodging chains which are centrifuged outwardly to dislodge silage from the mass as the shaft is rotated. Although these silo unloaders are highly successful, a problem sometimes develops in sealing around the shaft above the supportive bearings so that water, silage and other corrosive or foreign material does not leak past the seal and come in contact with the supporting bearings causing premature bearing failure or excessive maintenance.

In prior art bottom type silage unloaders, annular seals have been formed of flexible material such as rubber but these tend to wear rapidly and have a relatively short operating life because of contact with corrosive materials and the action of the liquids developed in the silage means and the abrasive nature of some of the materials contained. Frequent replacement of the seals and bearings is often a costly and time consuming problem.

Therefore, an object of the present invention is to provide a new and improved seal for bottom type silo unloaders of the character described which seal is effective in protecting the shaft and its supporting bearings from damage because of contact with liquids, silage and other corrosive materials contained in the silos.

Another object of the present invention is to provide a new and improved bottom silo unloader.

Still another object of the present invention is to provide a new and improved bottom silo unloader requiring less maintenance and reducing the need and frequency of replacing seals and bearings.

SUMMARY OF THE INVENTION

The foregoing and other objects and advantages of the present invention are accomplished in an illustrated embodiment by way of example and not limitation including a new and improved bottom type silo unloader for use with a bottom unloading type silo having a discharge opening in a bottom wall. The unloader includes a housing adapted to be mounted in the discharge opening and includes an upper wall having a shaft opening. A shaft is supported on bearings which are enclosed and mounted in the housing below the upper wall and the shaft extends upwardly through the shaft opening of the housing wall into the center of the silo. The shaft supports a plurality of flexible, silage dislodging members which are centrifuged outwardly to flail against and dislodge the silage from the large mass of silage contained in the silo. The dislodged silage is then diverted downwardly through a discharge opening provided in the upper wall of the unloader housing.

In accordance with the invention, a new and improved rotary lap seal is provided around the shaft adjacent the shaft opening in the upper housing wall in order to protect and prolong the shaft supporting bearings which are mounted in the housing. The seal comprises an inside, annular collar around the shaft which extends upwardly of the upper housing wall and a cooperative outside annular collar which is spaced around the inside collar and is supported from the shaft to rotate therewith. The outside collar projects downwardly below the upper end of the inside collar thereby forming an annular overlapping seal area between the collars. In order for liquid or silage to penetrate into the unloader housing via the shaft opening in the upper housing wall, the liquid must climb upwardly on the inside collar to a level above the upper end and then spill over into the space between the inner surface of the inside collar and the shaft. It has been found in testing silo unloaders as described herein, that water or other liquid in the silo does not flow upwardly to penetrate the overlapping seal and the bearings which support the shaft in the housing below are well protected from water and other corrosive acids which develop in the silo. In some instances, the silage material itself may tend to collect in a ring and remain within an area defined between the overlapping collars forming an additional seal to prevent liquid and other unwanted material from moving inwardly and downwardly on the shaft within the inside collar.

BRIEF DESCRIPTION OF THE DRAWINGS

For a better understanding of the present invention, reference should be had to the following detailed description taken in conjunction with the drawings in which.

DESCRIPTION OF THE PREFERRED EMBODIMENT

Figure 1:
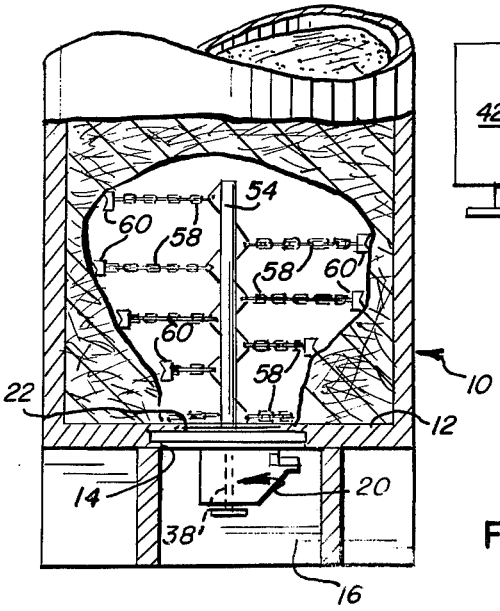
FIG. 1 is a vertical, elevational sectional view showing a bottom unloading silo with a silage unloader mounted therein constructed in accordance with the features of the present invention.

Referring now more particularly to the drawings, in FIG. 1 is illustrated the lower end portion of a silo 10 having a bottom wall 12 with a central discharge opening 14 therein. An open space 16 is provided below the discharge opening in the bottom wall to accommodate a new and improved bottom unloader in accordance with the invention generally indicated by the reference numeral 20. The unloader is mounted in the opening and is supported from the bottom wall of the silo by means of a frame 22. The frame is connected to the upper end portion of a housing 24 having a pair of side walls 26 of the shape illustrated in FIG. 2 and the housing is partially closed on top by a top wall 28. The housing also includes the pair of transverse side walls 30 and 32 which form an enclosed shaft housing or subcompartment 36. The top wall 28 is provided with a circular opening 28*a* (FIG. 3) to accommodate a vertical shaft 38 which projects upwardly into the interior of the lower portion of the silo. At the lower end, the shaft extends downwardly and a sprocket or pulley 40 is mounted on the lower end. The sprocket or pulley is drivingly interconnected to an electric motor 42 or other suitable rotative power source by means of a V-belt or chain 44 entrained around a sprocket or pulley on the motor rotor shaft.

The main shaft 38 is supported in the shaft housing 36 by a pair of pillow block type bearing units 46 and 48 and the bearing units are secured to mounting blocks or bases 50 attached to the housing wall 32 by mounting bolts and nuts 52. The bearing units 46 and 48 are aligned in coaxial vertical alignment so that the shaft 38 is driven to rotate around a vertical axis whenever the motor 42 is energized.

As shown in FIG. 1, the shaft 38 projects upwardly into the lower portion of the silo and a hollow sleeve 54 is mounted on the shaft and secured by bolts 56 for supporting a plurality of flexible chains 58 connected to the sleeve at several elevations in the silo as shown and described more fully in U.S. Pat. No. 3,907,131 which is incorporated herein by reference. The chains 58 are cut to appropriate lengths and are provided with digging or cutting elements 60 on the outer ends for dislodging of the silage material as the shaft 38 and sleeve 54 are rotated.

Figure 3:
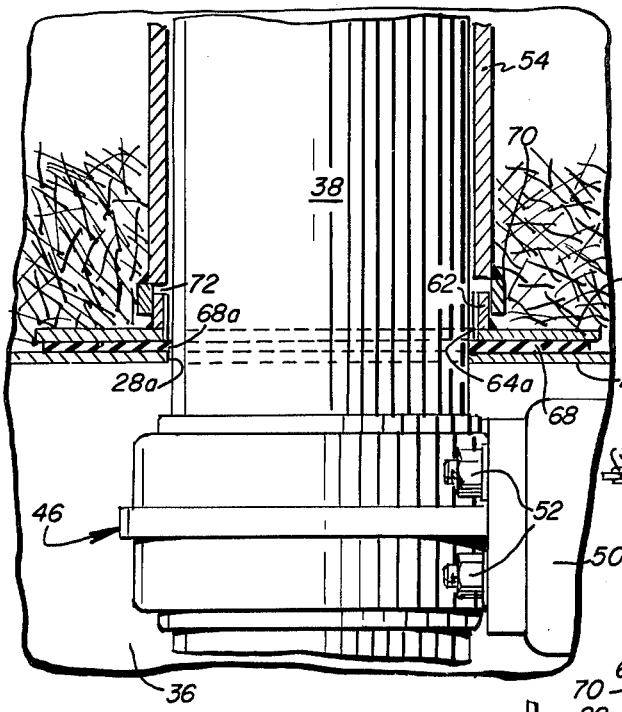
FIG. 3 is a greatly enlarged, fragmentary, vertical elevational view, with portions in section, showing in detail a new and improved lap type sealing arrangement of the bottom silo unloader in accordance with the features of the present invention.
Figure 2:
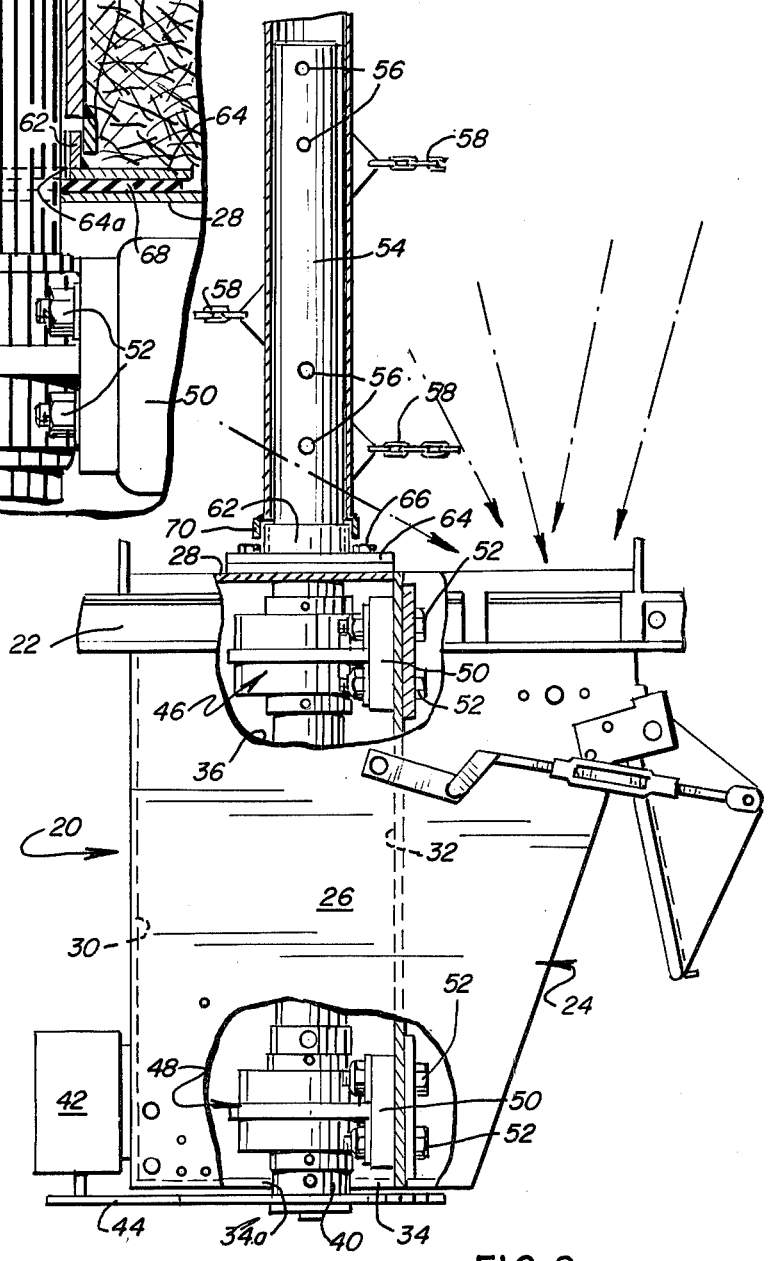
FIG. 2 is an enlarged fragmentary, vertical elevational view, with portions in section, showing the silo bottom unloader of FIG. 1 as constructed in accordance with the features of the present invention.

Silage material stored in silos often contains a considerable amount of water and in addition, the silage sometimes undergoes a chemical reaction which produces corrosive liquids which are very deleterious to bearings and other precision parts of the unloader 20. Accordingly, it is important that the main bearing units 46 and 48 be sealed from the liquid and corrosive material in the silo. In accordance with the present invention, the silo unloader 20 includes an overlapping annular seal formed around the shaft 38 above the upper bearing 46 and this seal prevents any liquids and corrosive materials from entering the upper end of the shaft housing 36 through the opening 28*a* in the upper wall. The shaft seal includes an inside annular collar 62 of cylindrical shape which projects upwardly from a flat annular seal plate 64 which is removably secured in place on the upper wall 28 around the shaft by means of bolts 66 (FIG. 2). The annular seal plate 64 is provided with a circular opening 64*a* slightly larger in diameter than the outer diameter than the shaft 38 and approximately equal in diameter to the inside diameter of the inside collar 62 as shown in FIG. 3. Beneath the annular seal plate 64, an annular sealing gasket 68 is provided for additional sealing around the running shaft 38 in the vicinity of the housing wall 28 where the shaft passes through the circular opening 28*a*. The resilient gasket 68 is provided with a circular opening 68*a* having a diameter approximately equal to that of the shaft 38.

In cooperation with the inside collar 62, the annular overlapping seal includes an outside annular collar 70 which is welded or otherwise secured to depend from the lower end of the sleeve 54 carried by the shaft. The outside collar 70 is formed with an inside diameter slightly greater than the outside diameter of the inside collar 62 and the outside collar extends downwardly so that its lower end is spaced below the upper end of the inside collar to provide the annular overlapping seal area. The inside collar is welded or otherwise attached to the annular seal plate 64 in a watertight manner so that liquid collecting on the housing wall or seal plate cannot directly enter the opening 28*a* in the upper housing wall. Liquid that collects on the housing wall 28 can only penetrate by upward movement through the narrow annular overlapping seal space between the facing portions of the inside and outside collars. Should this occur, the liquid would have to pass through resilient seal 68 before it could come in contact with the bearings 46 and 48 in the shaft housing. It has been found in testing of the silo unloader 20 of the present invention, that liquid, in fact, does not pass through the overlapping running seal as described either during operation of the unloader or when the unloader is not in operation. Moreover, it has been determined that silage material sometimes is accumulated in an annular space 72 (FIG. 3) above the inside collar 62 and that the material itself forms another positive seal around the shaft 38 to further aid in preventing moisture and other corrosive liquids from reaching the shaft. It has also been found that precise clearance is not required between the outer surface of the inside collar 62 and the inner surface of the outside collar 70 for the overlapping seal to be completely effective in blocking off the flow of water and corrosive liquids from contact with the bearings 46 and 48 supporting the rotating shaft. The overlapping seal provides for a longer life for the resilient seal gasket 68, which gasket now serves a secondary insurance against the unwanted entry of liquids and materials into the upper end of the subchamber 36.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A silo unloader for a bottom unloading type silo having a discharge opening in a bottom wall thereof, said unloader comprising:

a housing adapted to be mounted in said opening and including an upper wall having a shaft opening therein;

a shaft supported on bearings in said housing below said upper wall and extending upwardly through said shaft opening into said silo for supporting a plurality of flexible silage dislodging members;

a rotary seal between said shaft and said shaft opening in said upper housing wall comprising an inside annular collar spaced outwardly around said shaft and secured to extend upwardly of said upper wall and an outside annular collar spaced outwardly around said inside collar sealed with and supported from said shaft to rotate therewith and having a lower edge portion projecting downwardly below an upper end of said inside collar forming an annular overlapping seal between said collars;

an annular seal ring of flat resilient material spaced below said collars and having an opening with edges closely confronting said shaft; and an annular seal plate removably secured adjacent said upper wall for holding said seal ring compressed against said upper wall and supporting said inside collar with a lower end of said inside collar secured to said plate.

2. The silo unloader of claim 1 including a sleeve removably mounted on said shaft for supporting said flexible silage dislodging members, said outside annular collar mounted adjacent a lower end of said sleeve.

3. The silo unloader of claim 1 wherein said inside collar includes an inner surface spaced outwardly of said shaft forming an annular sealing chamber in communication with the interior of said silo between said collars.

* * * * *